US005799451A

United States Patent [19]

Pilakoutas

[11] Patent Number: 5,799,451

[45] Date of Patent: Sep. 1, 1998

[54] REPAIR AND REINFORCEMENT OF LOAD BEARING MEMBERS

[75] Inventor: Kypros Pilakoutas, Sheffield, United Kingdom

[73] Assignee: The University of Sheffield, United Kingdom

[21] Appl. No.: 535,041

[22] PCT Filed: Apr. 15, 1994

[86] PCT No.: PCT/EP94/01222

§ 371 Date: Dec. 14, 1995

§ 102(e) Date: Dec. 14, 1995

[87] PCT Pub. No.: WO94/24391

PCT Pub. Date: Oct. 27, 1994

[30] Foreign Application Priority Data

Apr. 17, 1993 [GB] United Kingdom ..... 9307979.6

[51] Int. Cl.[6] ..... E04C 3/34

[52] U.S. Cl. ..... 52/223.4; 52/514; 52/721.4; 52/736.3; 52/737.4; 52/738.1; 52/741.3

[58] Field of Search ..... 52/514, 721.4, 52/721.5, 223.4, 741.3, 736.3, 736.4, 737.4, 737.5, 738.1

[56] References Cited

U.S. PATENT DOCUMENTS

| | | | |
|---|---|---|---|
| 1,107,255 | 8/1914 | Rae . | |
| 2,480,180 | 8/1949 | Bolton . | |
| 3,813,098 | 5/1974 | Fischer et al. | 52/738 X |
| 3,817,010 | 6/1974 | Stegmuller . | |
| 4,323,200 | 4/1982 | Denoor . | |
| 4,432,175 | 2/1984 | Smith . | |
| 4,786,341 | 11/1988 | Kobatake . | |
| 5,043,033 | 8/1991 | Fyfe . | |
| 5,133,510 | 7/1992 | Davis . | |
| 5,218,810 | 6/1993 | Isley, Jr. | 52/736.3 X |
| 5,326,410 | 7/1994 | Boyles | 52/514 X |
| 5,444,952 | 8/1995 | Jackson | 52/574 X |

FOREIGN PATENT DOCUMENTS

| | | |
|---|---|---|
| 3806759 | 9/1989 | Germany . |
| 0674297 | 6/1952 | United Kingdom . |
| 1446425 | 8/1976 | United Kingdom . |
| 9320296 | 3/1993 | WIPO . |

*Primary Examiner*—Robert Canfield
*Attorney, Agent, or Firm*—Sheldon & Mak

[57] ABSTRACT

A method of laterally reinforcing a load bearing structural member is described. The method comprises wholly or partly encircling the structural member with an elongate strip (8) of high tensile, high stiffness material and applying a tension to the strip (8) sufficient to put the material of the structural member into lateral compression such that an abnormal increase in the internal stresses in the structural member will cause yielding of the strip (8) before compressive, bending, or shear failure of the structural member.

29 Claims, 3 Drawing Sheets

REPAIR AND REINFORCEMENT OF LOAD BEARING MEMBERS

BACKGROUND

This invention relates to the repair and reinforcement of structural members, and more particularly to the external lateral reinforcement of load bearing structural members.

The repair and strengthening of structures will progressively increase in importance in the construction industry due to the need for upgrading of an ageing building stock, which is chronically exposed to an environmental loading of varying nature. This is particularly true in areas where hazards, like earthquakes and strong winds have not been taken into account during the design stages. However, the need for strengthening of weak structures may also arise as a result of the introduction of new stricter codes of practice, better understanding or redefinition of expected loading and new definitions of risk. Notwithstanding the above, in places where quality control measures are still not strictly implemented during construction, many structures are still built with inherent errors due to bad design, poor construction materials and poor construction workmanship. Hence, a large proportion of buildings are in need of repair or strengthening, before they are even completed.

Many load bearing members, particularly reinforced concrete columns in structures and buildings, fail to perform satisfactorily in service, because they have insufficient strength and/or ductility to withstand the external forces involved. When the elastic limits of a structure subjected to external actions are exceeded, its ductility will be the deciding factor in preventing damage and collapse. Where damage has taken place, an urgent objective is to repair and reinforce any damaged structures.

A variety of repair and reinforcement methods are currently in use. These methods include, gluing of thin steel sheets, plate bonding, jacketing, heat tensioning of thin steel plates or tie plates, tying of steel ties using screws, heated and hammered spirals etc. Most such techniques are extremely costly, time consuming, need skilled personnel for welding and gluing, and require a further concrete jacket to be applied around the damaged member thereby increasing its dimensions. In addition, it is quite difficult to evaluate the effectiveness of any repair or reinforcement.

Other proposals have involved wrapping or winding various materials around the structural member. In GB1446425 a concrete structural member of circular section is surrounded by a tensioned wire of high tensile strength wound helically onto the member. In U.S. Pat. No. 4,786,341 a fibre-reinrorced plastic is applied onto the outer periphery of a concrete structural member. Finally in U.S. Pat. No. 5,044,044 a concrete column is overlapped with high strength stretchable fibres, coated with hardenable material to form an outer shell, and a hardenable liquid injected under the fibres in an amount sufficient to cause the stretching of the fibres. None of these methods have been found to be very efficient or effective.

In British Patent Nos. 1054588, 1156245, and 1157494, there is described a concrete pressure vessel which is circumferentially stressed by means of prestressing wires wound therearound under tension in a plurality of layers, such wires being accommodated in circumferential troughs or channels which are provided in or on the outer surface of the vessel or structure and serve to locate the layers of wires. However, the prestressed wires are merely positioned to assist the walls of the concrete pressure vessel or other circumferentially stressed concrete structure to withstand the internal pressure involved, and there is no suggestion that the pre-stressed wires increase the vessel's strength and ductility, when subjected to axial, bending and shear actions.

SUMMARY

It is an object of the present invention to provide a method of repairing, strengthening or reinforcing a structural member, which comprises laterally confining the member in order to improve its strength and ductility and thereby enhance its ability to withstand external forces, particularly of seismic origin.

In one aspect, the invention provides a method of laterally reinforcing a load bearing structural member which comprises wholly or partly encircling the structural member with an elongate strip of high tensile strength, high stiffness material and applying a tension to the strip sufficient to put the material of the structural member into lateral compression such that an abnormal increase in the internal stresses in the structural member will cause yielding of the strip before compressive, bending, or shear failure of the structural member.

In another aspect, the present invention provides a structural member having an elongate strip of high tensile strength, high stiffness material positioned therearound, the strip having applied thereto a tension sufficient to put the material of the structural member into lateral compression such that an abnormal increase in the internal stresses in the structural member will cause yielding of the strip before compressive, bending, or shear failure of the structural member.

The structural member is a solid (not hollow) element which may be, for example, a reinforced concrete column or beam, a cantilever, slab or wall section, a parapet, a brick or masonry lintel, a highway post, a timber or steel column, a composite material structural element, or a plate bonded, strengthened structural element. other structural members such as the masts of ocean-going yachts may be strengthened using the method of the invention. Henceforth, the invention will be more particularly described with reference to load bearing reinforced concrete columns and beams, but it is to be understood that it is not limited thereto.

The elongate strip is preferably flat and preferably has a thickness of less than 1.5 mm, most preferably from 0.5 to 1 mm. The strip preferably has a width of less than 40 mm, most preferably from 10 to 30 mm. The dimensions of the strip should be such that the strip will not break when bent under tension around tight corners. The material of the strip is preferably a high tensile, high stiffness material, such as for example high tensile steel, although other high tensile, high stiffness materials, for example structural polymers such as polypropylene and fibre reinforced plastics comprising for example carbon fibre, glass fibre and aramids are not excluded. Preferably the strip to be pre-stressed should have an ultimate stress value of greater than 350 $N/mm^2$, more preferably greater than 500 $N/mm^2$. High tensile material is preferred because a lower volume of strip material can be used, but we have found that for a particular stiffness of material there is an optimum value for the ultimate stress of the strip beyond which, if no pre-stressing force is applied, no further strength and ductility improvement is obtained, and indeed poorer results may be achieved. Thus, the ultimate stress value of an unstressed (but not loose) steel strip preferably lies in the range of from 200 to 400 $N/mm^2$.

We have found that to obtain optimum performance, it is necessary to ensure the optimum utilisation of the strip strength. Suitable metal strips are currently manufactured having strengths of from 300 to 1000 N/mm$^2$. The applied tension should preferably induce a stress in the strip close to and preferably within 400 N/mm$^2$, more preferably within 200 N/mm$^2$ of its yield stress. For example, for a metal strip of yield stress 800 N/mm$^2$ the applied tension is preferably in the range of 600 to 800 N/mm$^2$ for moderate amounts of confinement, although the applied tension can be reduced if higher levels of confinement are used. It is important that the applied tension is sufficient to overcome any friction in the system and ensure that the strip is tightly applied to the structural member, however, and this generally requires the use of an applied tension of at least about 100 N/mm$^2$.

It is important that the tension applied to the metal strip is sufficient to put the material of the structural member into lateral compression as determined which, for example, can be based on Eurocode 8 (EC8 1993). Since the effect of the load on the structural member tends to cause cross sectional expansion of the load bearing member, the tension of the strip should be sufficient to counteract this tendency and to maintain the structural member in lateral compression. In such a situation, an abnormal increase in the load bearing forces, due, for example, to seismic disturbances, causing a potentially damaging expansion of the load bearing member, will be resisted by the tension in the strip. It is believed that the effective lateral stress prior to yielding of the strip in these circumstances serves to equalize the forces on the load bearing member so that it continues to respond in a ductile manner. Only after yielding of the strip will compressive failure or bending failure of the structural member take place. Brittle failures, such as shear failure, could conceivably be totally eliminated by suitable reinforcement in a preferred manner in accordance with the invention.

The strip may be applied to the load bearing structural member as a plurality of separate bands or as a spiral strapping and may be retained on the load bearing member by means of appropriately configured clips, which may be applied to the corner regions of the structural member. whichever method is used, preferably adjacent turns of the strip are clipped together to prevent slippage and maintain the applied tension. Corner protectors may also be used, if desired, to minimise damage to the corners of the structural member by the strip and increase the confinement efficiency.

The strip may be applied to the structural member by any suitable means, and a variety of commercial strapping machines for baling and packaging may be used, if necessary, with appropriate modifications. Suitable strapping machines can be either hand operated or powered, for example by compressed air or hydraulic pressure. Preferred machines can provide control of the level of tensioning force and may also incorporate a clip sealer. Metal clips are preferably used to ensure proper sealing or the tensioned strip. The metal strip may be applied to the load bearing member so that individual turns are overlapping, just touching, or are spaced apart, depending upon the application. It is usually possible to space apart the individual turns of the metal strip, in general, by an amount of from 0 to 300 mm.

Structural members reinforced by the method of the invention can have improved strength and substantially improved ductility, imparting resistance to compressive failure, bending failure and shear failure. Localised failures such as buckling, pull-out or peeling of the concrete cover can also be reduced.

DRAWINGS

In order that the invention may be better understood, preferred embodiments thereof will now be described in detail below, by way of example only, with reference to the accompanying drawings, in which :

FIG. 1*a* schematically shows an end elevation of a fully encircled load bearing member according to the invention;

FIG. 1*b* shows an end elevation of a second fully encircled load bearing member according to the invention;

FIG. 1*c* shows an end elevation of a partially encircled load bearing member according to the invention;

FIG. 2*a* shows a side elevational view of a load bearing member according to the invention encircled with individual strips;

FIG. 2*b* shows a side elevational view of a load bearing member according to the invention encircled with a spiral strip;

DESCRIPTION

Figure 1A:
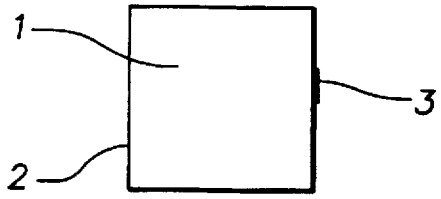
Figure 1B:
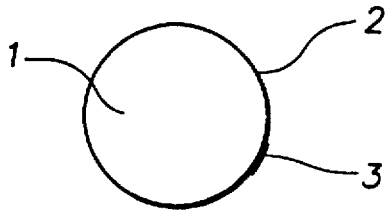

Referring firstly ton FIGS. 1*a* and 1*b*, there are shown reinforced concrete load bearing members 1, encircled with pre-tensionsed high tensile steel strips 2, the strips being secured in a tensioned state by clips 3.

Figure 1C:
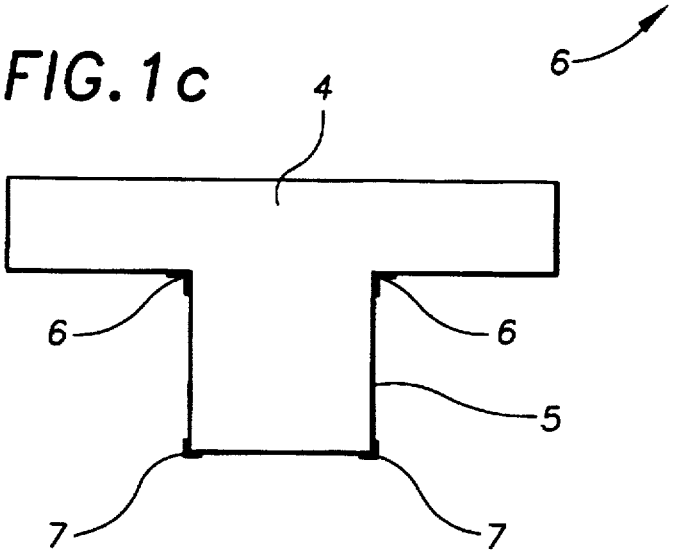

In FIG. 1*c* , a reinforced concrete member 4 of T-shaped section is partially encircled by pre-tensioned strips 5, which are secured by fixings 6 onto the member 4. Corner protectors 7 are provided on those corners encompassed by the strips.

Figure 2A:
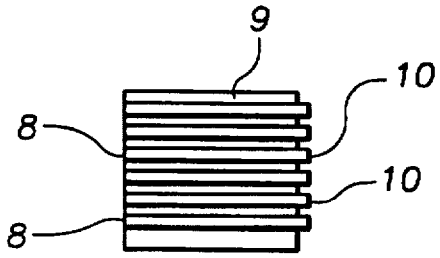
Figure 2B:
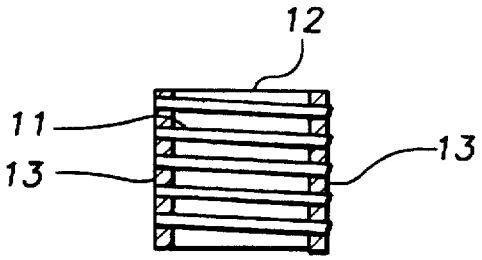

FIGS. 2*a* and 2*b* show strip wrapping methods. In FIG. 2*a* individual strips 8 are wound around the member 9 and each is secured by its own clip 10. In FIG. 2*b* a single strip 11 is spiralled around the member 12 and secured on the corner protectors 13, which incorporate clips at suitable spacings.

The invention will now be illustrated by the following Examples.

EXAMPLE 1

Axial Strength and Ductility

This Example demonstrates the increase in load and longitudinal strain resulting from three laterally confined concrete cylindrical specimens reinforced according to the invention, and a comparison of these specimens with a control unconfined specimen in axial loading tests.

The three concrete cylindrical specimens of 100 mm diameter and 200 mm height are cast vertically using standard steel forms. Each of the specimens is confined externally with Bryten type metal strips of 12.7 mm width and 0.5 mm thickness, having an average ultimate stress of 490 N/mm$^2$. The clear spacing (s') between strips for the three specimens were 0, 12.7, 25.4 mm respectively. The metal strips are tensioned around the specimens using a hand operated tensioning machine, and are secured in place by means of metal clips. The tension applied to the strips is determined to be 100 N/mm$^2$.

Figure 3:
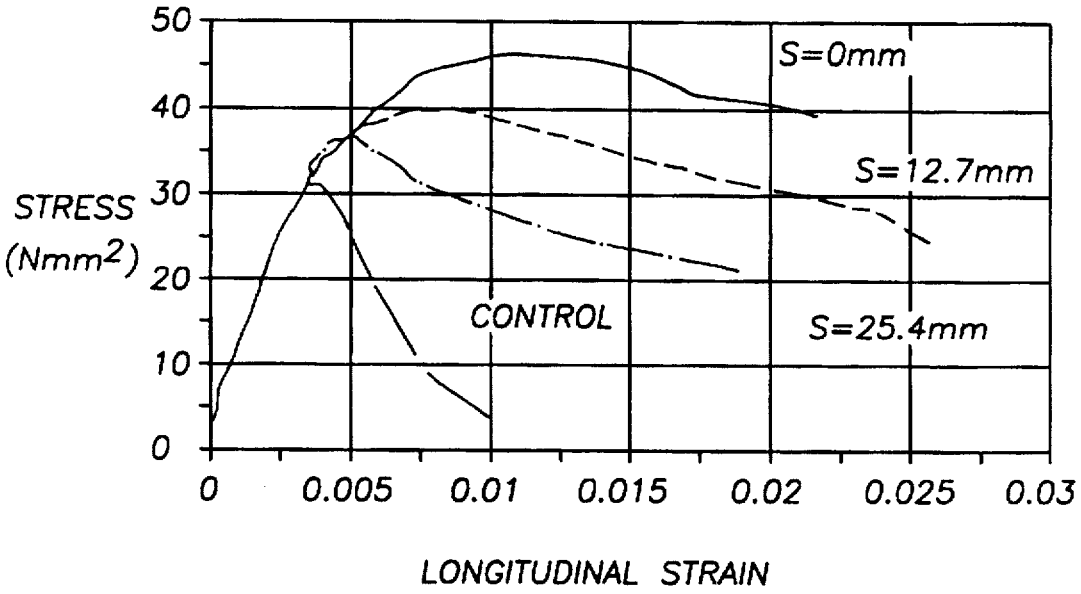
FIG. 3 shows a graph of the stress/strain curves of Example 1.

The stress/strain carves for the three specimens were plotted and the results illustrated in FIG. 3 of the accompanying Drawing. The results indicate a substantial improvement in longitudinal strain obtained with the method of the present invention.

EXAMPLE 2

Shear Strength

This example demonstrates the use of the method of the invention to reduce potential shear failures.

Figure 4:
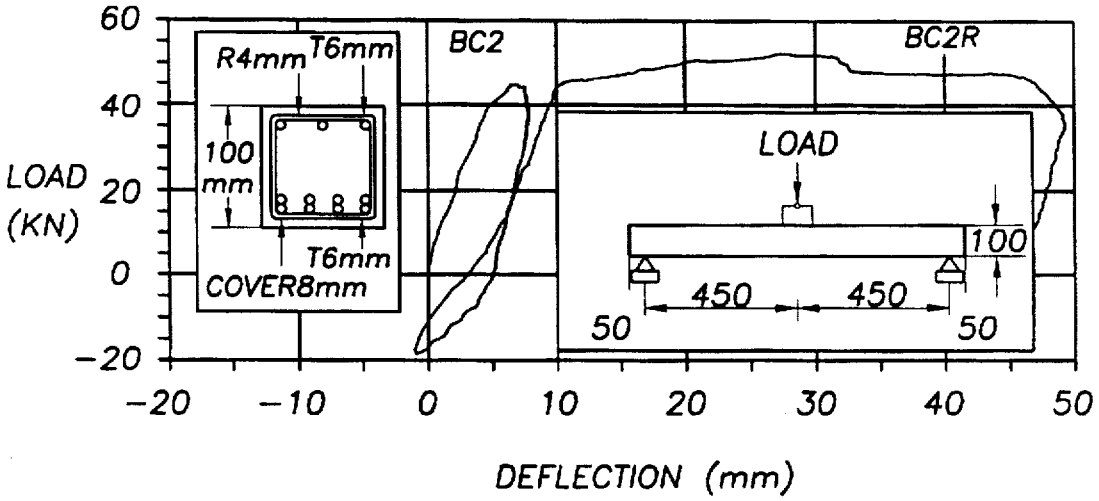
FIG. 4 shows a graph of the stress/strain curves of Example 2.

A reinforced concrete specimen is prepared, 1 meter long with a square cross section of 100 mm. The placement of reinforcing rods is as shown in FIG. 4. The specimen is tested in bending as a simply supported beam, with a mid-point load. After failure, the specimen is repaired, strengthened and re-tested. The results are shown in FIG. 4.

The specimen is designed to fail in shear. According to British Standard ES 8110 (BS 8110, 1985), stirrups of 4 mm diameter and 40 mm spacing are required to avoid shear failure, but instead, a 80 mm spacing is used. After the expected abrupt shear failure has taken place in the original specimen, crushed and loose concrete is removed and the compression side of the specimen is repaired by using an epoxy resin. The repaired specimen is strengthened externally by using the same metal strips as in Example 1. The spacing between the strips is 80 mm and the applied tension is determined to be 100 N/mm$^2$. The load deflection curve, before and after repair, is shown in FIG. 4.

As a result of strengthening, an increase in the specimen load carrying capacity is achieved, enabling it to reach high ductility levels without shear failure occurring. Hence, it is clearly demonstrated that a member deficient in shear capacity can be easily strengthened with the proposed technique, to avoid shear failure and even achieve high ductility.

The reduction in the initial stiffness of the repaired section in relation to the original stiffness of the specimen, observed in all repaired specimens, can be attributed to the reduction in stiffness of the longitudinal reinforcement after yield, and to a lower degree to the large numbers of tensile cracks remaining untreated after repairing the specimen.

EXAMPLE 3

Strength and Ductility Enhancement of Large Scale Glass Fibre Reinforced Plastic (GRP) Beams This example demonstrates the use of the invention in providing ductility to potentially brittle members reinforced with new materials.

A group of test pieces are made, consisting of concrete beams, 2.5 m long with a 150×250 mm cross section, each reinforced with two Glass Fibre Reinforced Plastic (GFRP) rods. The beams are tested in bending by applying a two point load at a distance of 700 mm from each support. In this example, the results obtained from one such beam, before and after repair, are presented in FIG. 5. The original beam, being technically over-reinforced, failed due to concrete crushing in a brittle explosive manner. After failure, the beam is repaired by replacing the crushed concrete and strengthening with Superten metal strips of 12.7 mm width, 0.5 mm thickness and 950 N/mm$^2$ ultimate stress. The strips are pre-stressed to a level of 100 N/mm$^2$.

Figure 5:
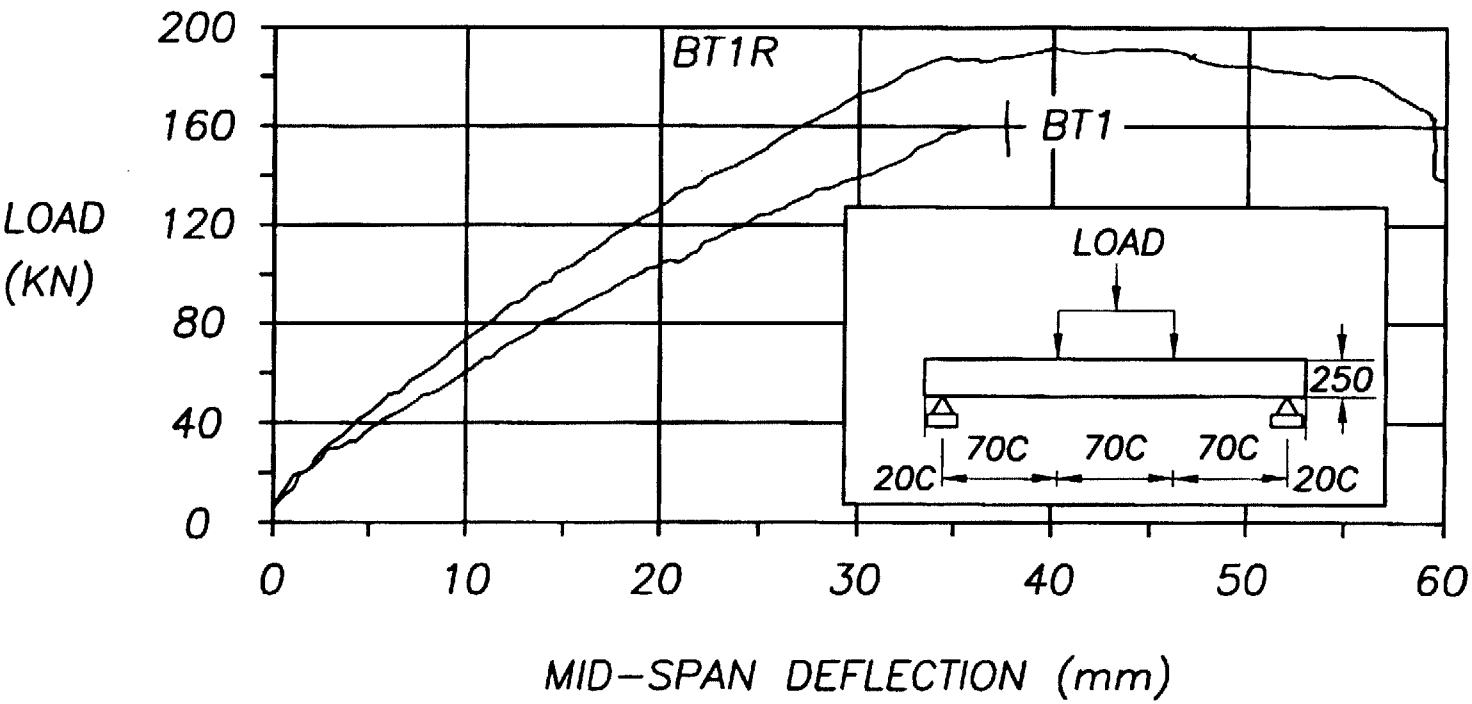
FIG. 5 shows a graph of the load/deflection curves of Example 3.

The strengthening of the beam resulted in an increase in the load carrying capacity of the beam by almost 20%, and more significantly, in forcing the beam to behave in a more ductile manner, as shown in FIG. 5. These results demonstrate that it is possible to design reinforced concrete members with new reinforcing materials, which do not comply with the under-reinforced category and yet give adequate warning prior to collapse.

In a further experiment-the procedure of Example 3 is repeated except that the strips are pre-stressed to a tension of 600 N/mm$^2$. A similar increase in the strength and ductility of the beam is observed.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract and drawings), and/or all of the steps or any method or process so disclosed, may be combined in any combination, except combinations where at least some of such features and/or steps are mutually exclusive.

Each feature disclosed in this specification including any accompanying claims, abstract and drawings), nay be replaced by alternative features serving the same, equivalent or similar purpose, unless expressly stated otherwise. Thus, unless expressly stated otherwise, each feature disclosed is one example only of a generic series of equivalent or similar features.

I claim:

1. A structural member having an elongate strip positioned therearound, the strip having applied thereto a tension sufficient to put the material of the structural member into lateral compression such that an increase in the internal compressive stresses in the structural member causes yielding of the strip before compressive, bending, or shear failure of the structural member.

2. A structural member according to claim 1, which comprises a reinforced concrete column.

3. A structural member according to claim 1, in which the elongate strip has a thickness of less than 1.5 mm and a width of less than 40 mm.

4. A structural member according to claim 1, in which the strip is comprised of high tensile steel.

5. A structural member according to claim 1, in which the strip has an ultimate stress value of greater than 500 N/mm$^2$.

6. A structural member according to claim 1 in which the applied tension is at least about 100 N/mm$^2$.

7. A structural member according to claim 1, in which the applied tension is in the range of 600 to 800 N/mm$^2$.

8. A structural member according to claim 1, in which the applied tension is within 400 N/mm$^2$ of the yield stress of the strip.

9. A structural member according to claim 1, in which the strip is applied to the member as a band or as a spiral strapping.

10. A structural member according to claim 9, in which adjacent turns of the strip are clamped together.

11. A structural member according to claim 9, wherein the structural member comprises corner regions and in which the band or spiral strapping in retained on the load bearing member by clamps applied to the corner regions of the structural member.

12. A structural member according to claim 10, in which the individual turns of the strip are spaced apart by a distance of up to 300 mm.

13. A structural member having an elongate strip positioned therearound and retained on the structural member by clamps, the strip having applied thereto a tension sufficient to put the material of the structural member into lateral compression such that an increase in the internal stresses in the structural member causes yielding of the strip before compressive, bending, or shear failure of the structural member.

14. A method of laterally reinforcing a load bearing structural member which comprises the steps of at least partly encircling the structural member with an elongate strip of high tensile, high stiffness material and applying a tension to the strip sufficient to put the material of the structural member into lateral compression such that an increase in the internal stresses in the structural member causes yielding of the strip before compressive, bending, or shear failure of the structural member.

15. A method according to claim 14, in which the structural member is a load bearing reinforced concrete column.

16. A method according to claim 14, in which the elongate strip has a thickness of less than 1.5 mm, and a width of less than 40 mm.

17. A method according to claim 14, in which the strip is comprised of high tensile steel.

18. A method according to claim 14, in which the strip has an ultimate stress value of greater than 500 $N/mm^2$.

19. A method according to claim 14, comprising applying a tension at least about 100 $N/mm^2$ to the strip.

20. A method according to claim 14, comprising applying a tension in the range of 600 to 800 $N/mm^2$ to the strip.

21. A method according to claim 14, comprising applying a tension within 400 $N/mm^2$ of the yield stress of the strip.

22. A method according to claim 14, comprising applying the strip to the load bearing structural member as one or more bands or as a spiral strapping.

23. A method according to claim 22, comprising clamping together adjacent turns of the strip.

24. A method according to claim 22, comprising spacing apart individual turns of the strip by a distance of up to 300 mm.

25. A method according to claims 14, wherein the structural member comprises corner regions and the strip is retained on the load bearing member by clamps which are applied to the corner regions of the structural member.

26. A method according to claim 14, comprising applying the method to the repair of a damaged load bearing structural member.

27. A method according to claim 14, comprising wholly encircling the structural member with the elongate strip.

28. A method of laterally reinforcing a load bearing structural member, the method comprising the steps of:

at least partly encircling the structural member with a plurality of turns of an elongate strip of high tensile, high stiffness material;

clamping together adjacent turns of the strip; and applying a tension to the strip sufficient to put the material of the structural member into lateral compression such that an increase in the internal stresses in the structural member causes yielding of the strip before compressive, bending, or shear failure of the structural member.

29. A method according to claim 28, comprising wholly encircling the structural member with the elongate strip.

* * * * *